US006270089B1

(12) United States Patent
Marechal

(10) Patent No.: US 6,270,089 B1
(45) Date of Patent: Aug. 7, 2001

(54) SYSTEM FOR RAPIDLY LINKING A BOOT TO A SPORT ARTICLE AND A SKATE INCORPORATING SUCH SYSTEM

(75) Inventor: Laurent Marechal, Argonay (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/218,462

(22) Filed: Dec. 22, 1998

(30) Foreign Application Priority Data

Dec. 23, 1997 (FR) ..... 97.16746

(51) Int. Cl.[7] ..... A63C 1/99

(52) U.S. Cl. ..... 280/11.3; 280/11.31; 280/11.33; 280/11.224; 280/11.221

(58) Field of Search ..... 280/11.22, 11.27, 280/11.28, 11.31, 11.33, 11.3, 11.24; 36/115

(56) References Cited

U.S. PATENT DOCUMENTS

| | | | | |
|---|---|---|---|---|
| 98,437 | * | 12/1869 | Smith | 280/11.3 |
| 462,279 | * | 11/1891 | Rochonczy | 280/11.3 |
| 908,536 | | 1/1909 | Arlund . | |
| 2,998,260 | | 8/1961 | Meyer | 280/7.13 |
| 3,918,729 | * | 11/1975 | Peters | 280/11.3 |
| 4,132,424 | * | 1/1979 | Olivieri | 280/11.3 |
| 4,932,675 | | 6/1990 | Olson et al. | 280/7.13 |
| 5,123,664 | | 6/1992 | De Mars | 280/11.18 |
| 5,193,827 | * | 3/1993 | Olson | 280/7.13 |
| 5,314,199 | * | 5/1994 | Olson et al. | 280/7.13 |
| 5,961,130 | * | 10/1999 | Gorza | 280/11.2 |

FOREIGN PATENT DOCUMENTS

| | | |
|---|---|---|
| 2141360 | 7/1996 | (CA) . |
| 2720286 | 12/1995 | (FR) . |

* cited by examiner

*Primary Examiner*—J. J. Swann
*Assistant Examiner*—James S. McClellan
(74) *Attorney, Agent, or Firm*—Greenblum & Bernstein, P.L.C.

(57) ABSTRACT

A boot/sport article assembly wherein the boot has at least one locking member, the sport article has at least one associated locking device complementary to the locking member to define at least one locking system, respectively, and at least one element of each locking system is elastically displaceably mounted in the vertical direction so as to block the boot against the sport article by traction in the vertical direction during the locking operation.

18 Claims, 6 Drawing Sheets

SYSTEM FOR RAPIDLY LINKING A BOOT TO A SPORT ARTICLE AND A SKATE INCORPORATING SUCH SYSTEM

BACKGROUND OF THE INVENTION

1. Field of the Invention

The present invention relates to a system for rapidly linking a boot to a sport article, especially a gliding sport article, such as an ice skate, roller skate, or in-line roller skate.

2. Description of Background and Material Information

Conventional linking systems consist of straps, arranged in the area of the instep girth and the metatarso-phalangeal articulation, that are tightened on the boot. Such linking systems have the drawback of causing excessive pressures and painful spots in the tightening areas without providing, however, a definite clearance-free assembly of the boot to the gliding member.

Different solutions have been envisioned in order to obtain such assemblies, without creating painful tightening spots for the user, from complementary linking systems provided in the boot sole and on the upper portion of the gliding member.

For example, U.S. Pat. No. 908,536 provides a method for linking the boot to the gliding member (in this case, an ice skate blade) with a bayonet system. In a particular embodiment, two bayonet systems are provided in the longitudinal direction at the front, whereas a bayonet system perpendicular to the previous ones is provided at the rear.

Such a system imposes a pivoting movement of the rear portion whereas the front portion is already fixed and therefore requires substantial clearances for locking the boot.

Such clearances are incompatible with a good transmission of forces. Based upon Canadian Patent Publication No. 2,141,360, it is known to assemble a boot to an in-line roller skate frame through a buckle fastening at the rear on one of the sole edges. Such a system requires having a sole, on the one hand, extremely rigid, since it is what ensures the linkage to the frame through each of the ends, and that it is therefore subject to substantial forces of compression in the longitudinal direction and, on the other hand, overlapping with respect to the boot upper.

Obviously, such a boot is not well adapted for walking. A similar assembly system is disclosed in French Patent Publication No. 2,720,286 and is subject to the same drawbacks.

Finally, U.S. Pat. No. 4,932,675 discloses a principle for assembling a boot to a frame for an ice skate or roller skate using two pairs of wedge linkages at the front and at the rear, respectively, each wedge linkage having a double gradient in the vertical and transverse direction, respectively.

Such a linkage system requires a very rigid sole and is extremely difficult to achieve, given the existence of double ramps. Indeed, if the conical portions do not correspond or if they correspond incorrectly, a clearance harmful to a rigid and solid assembly will occur. Further, even if the ramps are adjusted correctly, such a system is very sensitive to vibrations and can very easily loosen itself, especially when roller skating which, in particular, causes vibrations.

In any case, the removability the boot is achieved at the expense of the rigidity and accuracy of the boot/gliding member assembly.

Moreover, the known assembly principles are all more or less complicated and require using two hands and the help of tools, especially for screwing. In addition, they are incompatible for using the boot as a walling shoe.

SUMMARY OF THE INVENTION

An object of the present invention is to overcome the aforementioned drawbacks, and especially to provide a system for assembling and rapidly linking a boot to a gliding member allowing a rigid assembly, and clearance-free in all directions, so as to guarantee a perfect transmission of forces and steering accuracy while being compatible with a boot sole that is relatively flexible and/or adapted for walking.

This object is achieved in the boot/sport article assembly according to the invention in that the boot has at least one locking member, that the sport article has at least one locking device complementary to the locking member to define at least one locking system, and that at least one element of each locking system is elastically displaceably mounted in the vertical direction so as to block the boot against the sport article by traction in the vertical direction during the locking operation.

Indeed, the elastic displacement in the vertical direction of at least one of the locking members allows guaranteeing a clearance-free linkage of the boot to the sport article by traction of the boot against the sport article. The assembly of the boot to the article by a traction in the vertical direction, instead of a compression in the longitudinal direction as with normal assembly embodiments, furthermore allows conserving a relative sole flexibility, compatible with the walking function of the boot, since it is the sport article against which the boot is pressed which will provide the required rigidity.

According to a preferred embodiment, the boot/sport article assembly has two locking systems arranged substantially along the longitudinal axis of the boot, and means for backlash elimination in the longitudinal direction and in the transverse direction, respectively, are associated with at least one locking system.

The linkage thus obtained is completely free of clearance in the three directions and furthermore allows compensating for manufacturing tolerances when the boot has one part made of molded plastic in the assembly zone.

BRIEF DESCRIPTION OF DRAWINGS

Other characteristics and advantages of the invention will be better understood in light of the following description and the attached drawings that illustrate, in a non-restrictive embodiments, how the invention can be constructed, and wherein.

DETAILED DESCRIPTION OF THE INVENON

Figure 1:
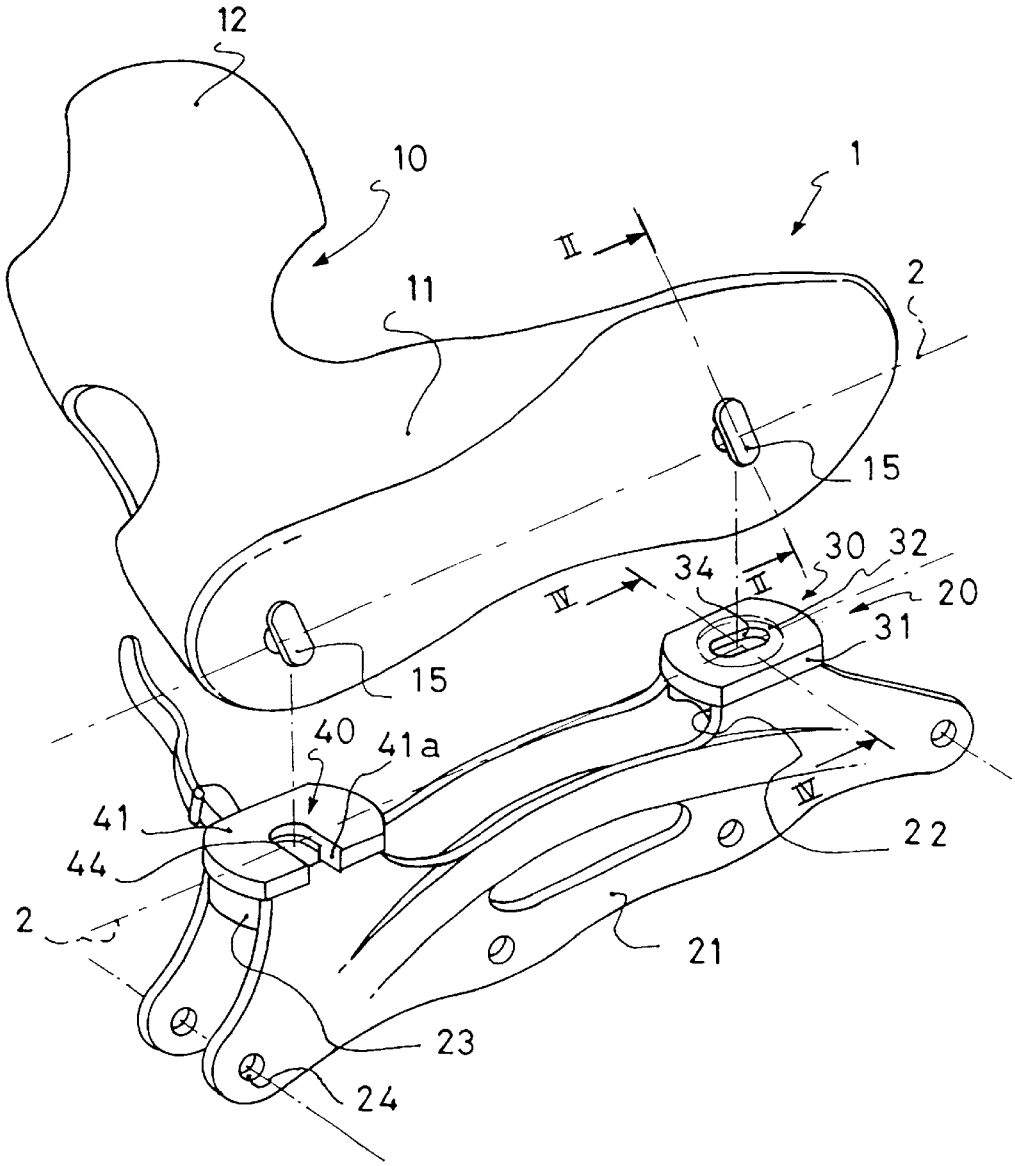
FIG. 1 is a perspective view showing a part of the boot and a part of the sport article before assembly.

FIG. 1 shows an assembly 1 constituted of a boot 10 and a sport article 20 according to the invention, and applied to roller skating. That is, the sport article 20 comprises the chassis of an in-line roller skate.

Only the frame of the boot 10 is shown, the latter being constituted of a low portion or cradle 11, preferably made of synthetic material, bearing two locking members 15 arranged along the longitudinal axis 2 of the assembly, and of a top portion or collar 12 extending upwardly from the cradle 11 to surround the user's ankle.

The construction of the boot 10 will not be described further, since the sleeve portion 12 could be omitted for a boot with a low upper, or could be built as an independent portion articulated on the cradle, etc.

Likewise, the cradle portion 11 could be made differently, the essential being that it is capable of receiving the locking members 15 to allow locking the boot 10 to the sport article 20.

Figure 2:
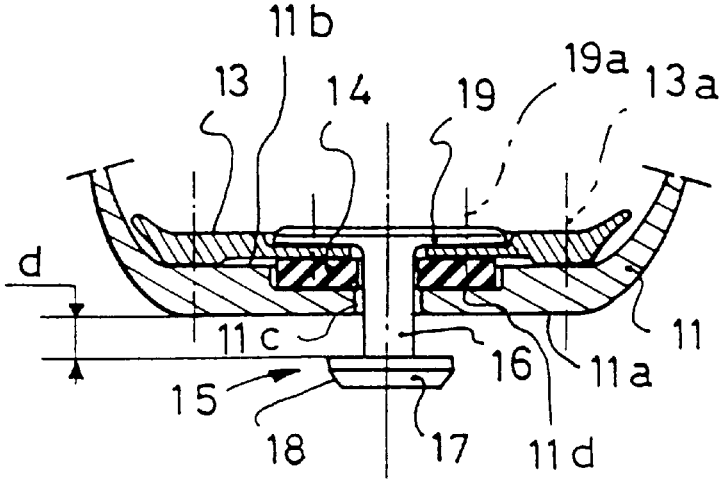
FIG. 2 is a cross-sectional view along the line II—II of FIG. 1 of a locking member of the boot.

In this case and as shown especially in FIG. 2, the locking members 15 are in the form of studs, each constituted of one part in the form of a cylindrical rod 16 projecting downwardly from the lower surface 11*a* of the cradle and ending in an elongated cap 17, extending in a "T" substantially transverse to the longitudinal axis 2, at a distance d from the lower surface 11*a* of the cradle. The peripheral edge of this cap is provided with a chamfer 18.

Furthermore, each locking member 15 is slidably mounted through its rod 16 into an associated hole 11*c* of the cradle and is fixed therein by a base 19 in the form of a disk, for example, assembled in a known manner (screw, rivet) in 19*a* on an internal, relatively flexible sole 13 of the cradle, the sole being fixed on the latter by screws, rivets, etc., 13*a*. A compressible washer 14 made of an elastomeric material, for example, is inserted between the sole 13 and an associated housing 11*d* provided in the bottom 11*b* of the cradle 11. As a result, each locking member 15 is mounted with a possibility for clearance with an elastic return in the vertical direction with respect to the cradle 11, so as to eliminate the possible backlashes in this direction, as described below. The elastic washer 14 also allows ensuring the sealing of the boot with regard to the exterior.

Figure 2A:
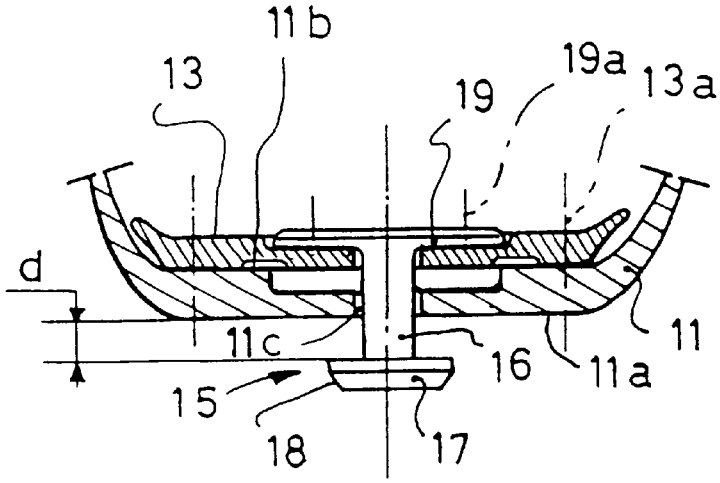
FIG. 2A is a view similar to FIG. 2 according to an alternative embodiment.

In the embodiment shown in FIG. 2*a*, the elastic washer 14 is eliminated and the elastic displacement of the locking member 15 occurs through the elastic displacement alone of its base 19 and of the internal sole 13.

A direct mounting of each locking member 15 onto the cradle 11 could also be envisioned, the latter providing the elasticity necessary for the elastic vertical displacement of the locking member 15.

Each locking member 15 is adapted to cooperate with an associated locking device 30, 40, respectively, of the sport article by constituting a front 15, 30 and rear 15, 40 locking system, respectively.

Only the frame 20 of this sport article is shown in the drawing and, in this case, it is constituted of two parallel flanges 21 linkedby two horizontal bridges 22, 23, respectively. Wheels (not shown in the drawing) are adapted to be fixed via holes 24 provided at the lower ends of the two flanges 21. Each bridge 22, 23 is bored with a similar through hole 22*a*, substantially aligned with the longitudinal axis 2.

Figure 4:
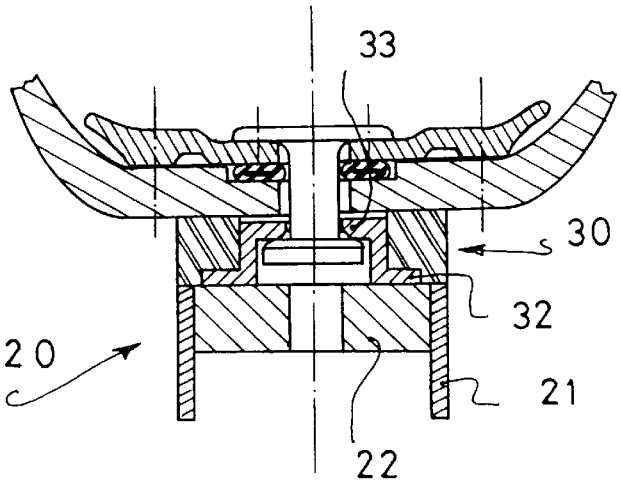
FIG. 4 is a cross-sectional view along the line IV—IV of the front locking system of FIG. 2, after introduction of the locking member of the boot.
Figure 5:
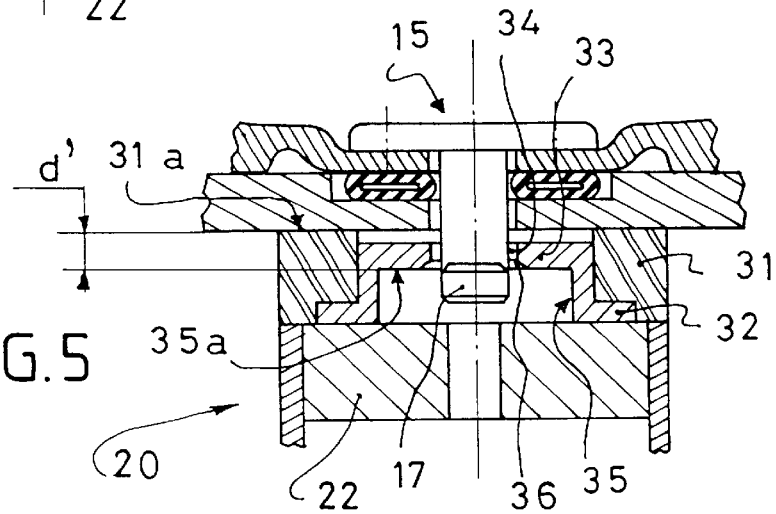
FIG. 5 is, on an enlarged scale, a view similar to FIG. 4, at the beginning of the locking.
Figure 6:
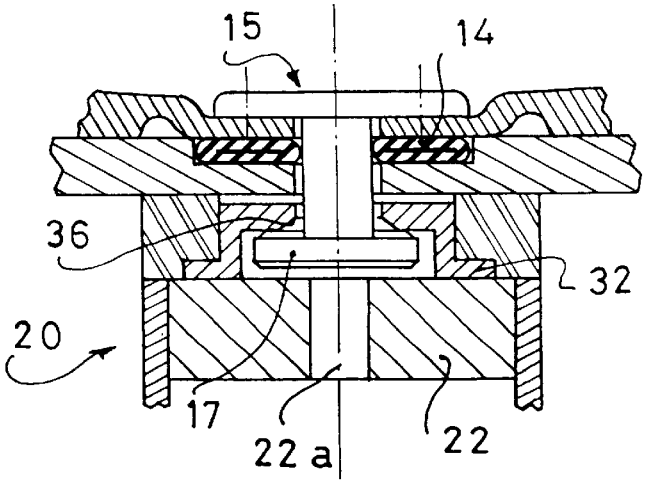
FIG. 6 is a view similar to FIG. 5 in a locking position.

As FIGS. 4–6 show more particularly, the front locking device 30 of the frame 20 is constituted of a casing 31 fixed on the front bridge 22 and confining a piece shaped like a circular bell constituting a fixed lock 32. This fixed lock 32 has, in its upper wall 33, a slot 34 having substantially the same shapes and dimensions as the cap 17 of the locking member 15 so as to allow passage of the latter, and the slot is arranged along the longitudinal axis 2, i.e., along an angle $\alpha$ equal to 90° with respect to the cap 17 of the associated locking member 15.

On the inside, the lock 32 defines a cylindrical cavity 35 constituting a housing capable of receiving the cap 17 of the locking member during a rotation thereof. As FIGS. 5 and 6 show more particularly, the lower edge of the slot 34 defines a transverse ramp 36 and the bottom 35*a* of the housing 35 is at a distance d' from the upper surface 31*a* of the casing 31 which is greater than the distance d mentioned previously (see FIG. 5).

Figure 3:
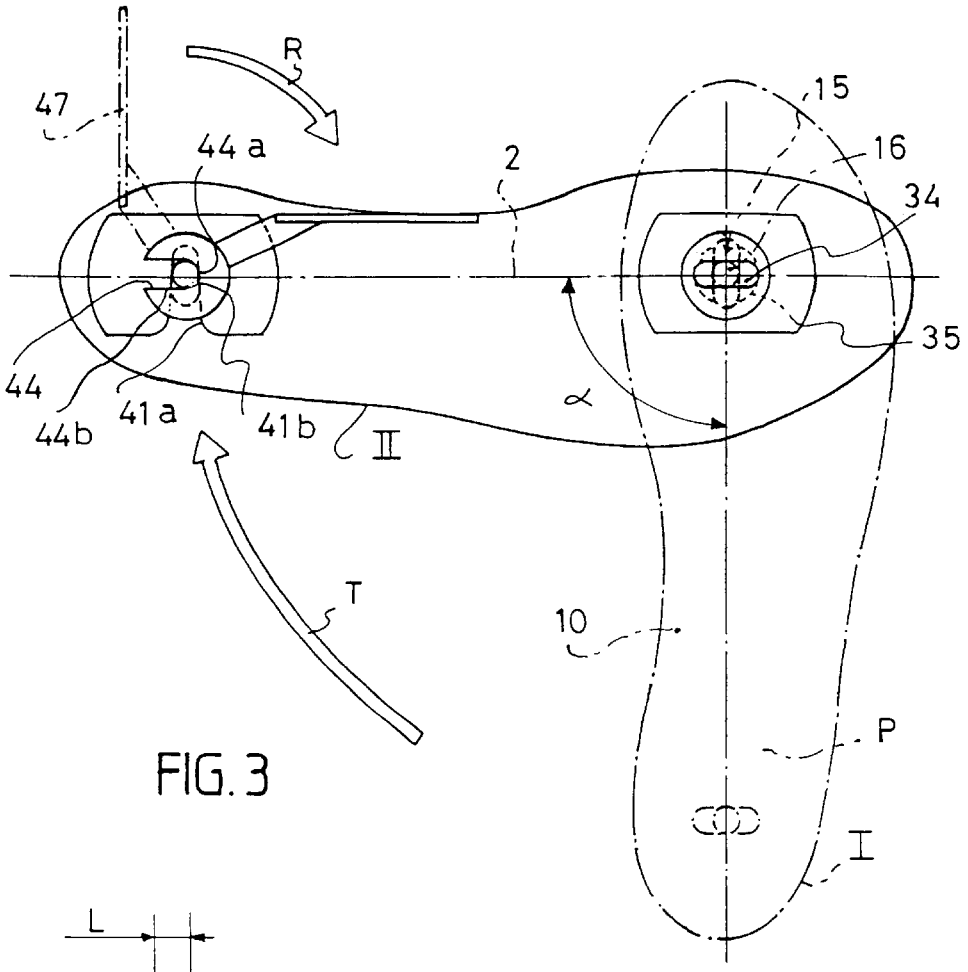
FIG. 3 is a schematic view showing the assembly method for the parts of the boot and of the sport article of FIG. 1.

The functioning of the front unlocking system is shown more particularly in FIG. 3. First of all, the boot 10 is placed on the frame 20 along a direction P perpendicular to the longitudinal axis 2 of the assembly, so that the cap of the locking member 15 is aligned with the slot 34 of the fixed lock 32 and can engage into the housing 35 thereof (see the position in dotted lines in FIG. 3).

Next, it suffices to pivot the boot one quarter of a turn, i.e., the value of the angle $\alpha$, along the arrow T in FIG. 3, in order for the cap 17 of the locking member 15 to be blocked in the lock in the position shown in solid lines in FIG. 2.

During this pivoting, the cap 17 descends along the ramp 36 and, due to the difference between the distances d and d', compresses the elastic washer 14, thus eliminating any vertical clearance between the locking member 15 and the lock 32. It is noted that this compression is also allowed through a corresponding flexion of the internal sole 13.

Thus, a first blocking of the boot 10 with respect to the frame 20 is obtained in the vertical direction, but also in the transverse direction through the cooperation of the longitudinal edges 34*a* of the slot 34 with the rod 16 of the locking member (see FIG. 3). The hole 22*a* of the bridge 22 allows removing dirt that can be found on the locking member 15 during the locking.

This first blocking of the boot 10 is achieved with a clearance L in the longitudinal direction (along the longitudinal axis 2) so as to compensate for the differences of the center distances of axes between the locking members 15 resulting from manufacturing constraints.

Figure 3A:
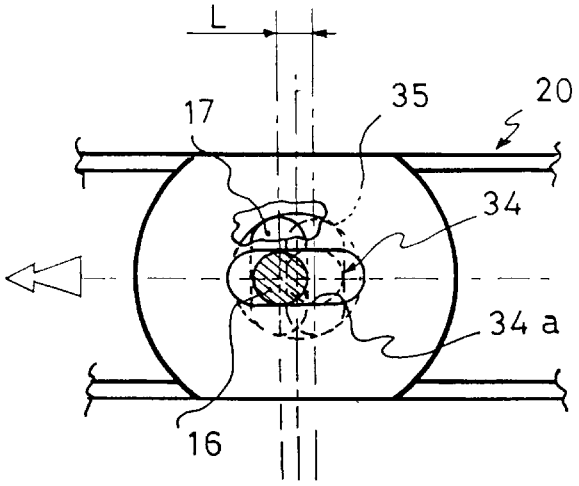
FIG. 3A is a detailed view of FIG. 3.

This longitudinal clearance L is shown in FIG. 3*a* and is defined by the cap 17 abutting with the circular bottom of the housing 35.

In fact, this clearance depends on the diameter of the housing 35 and, in this case, is selected so as to be greater than the tolerance of the center distances of axes between the locking members 15 during manufacture of the boot.

Other means could be provided to preserve this longitudinal clearance before the locking of the rear locking system 15, 40.

The front locking system 15, 30 could also be provided so that it occurs only after a pivoting α, of about 45° or less of the boot, for example, so as to have a more ergonomical movement. In this case, it suffices to provide a corresponding angular offset α between the slot 34 and the front locking member 15.

Figure 7:
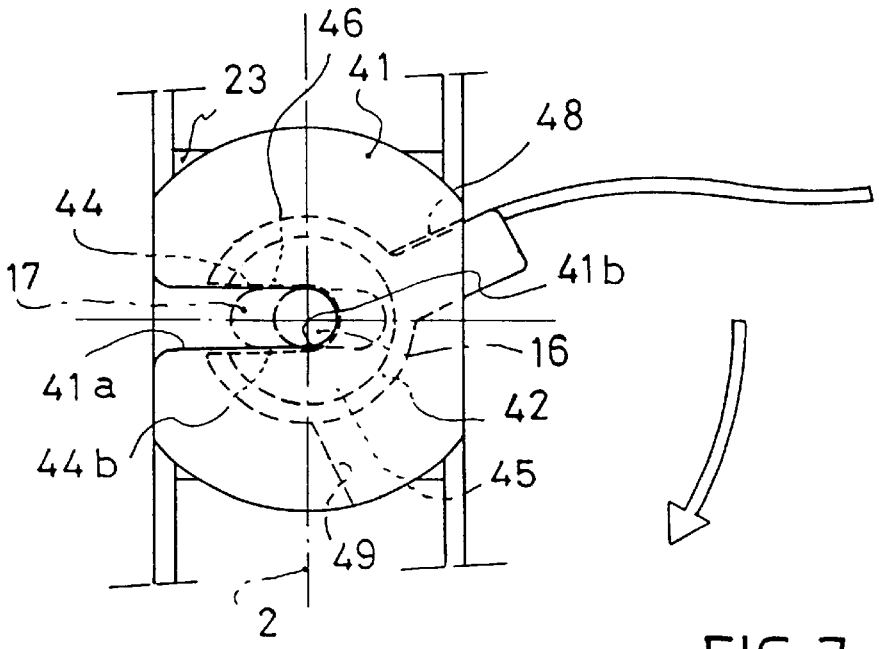
FIG. 7 is a top view of the rear locking system in an unlocked position.
Figure 8:
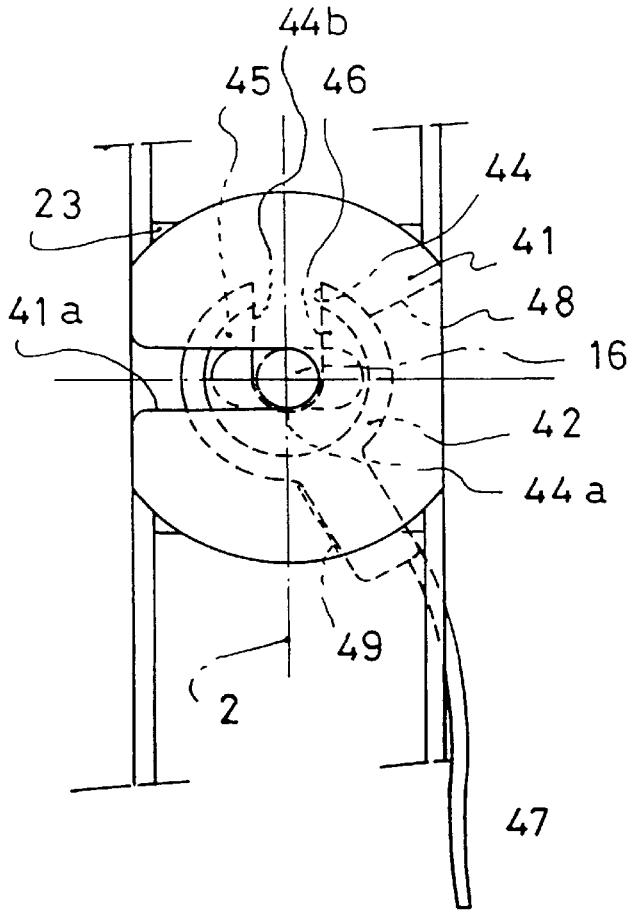
FIG. 8 is a view similar to FIG. 7 in a locking position.
Figure 9:
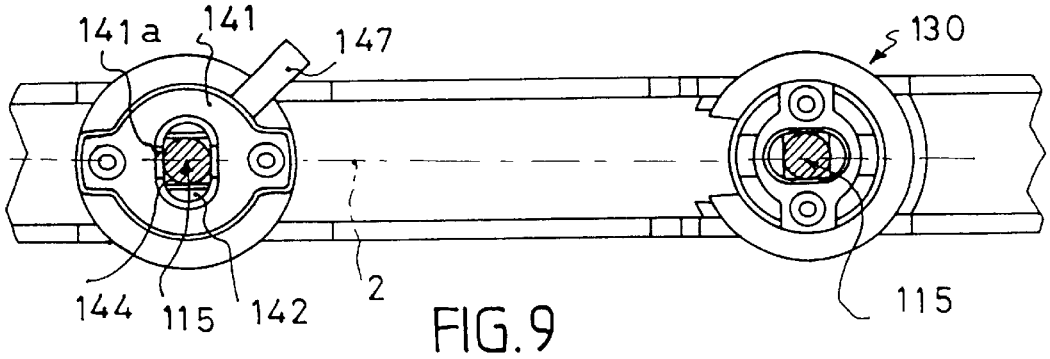
FIG. 9 is a partially cut top view of the two locking devices of the frame according to a second embodiment.

The second locking device 40 has a functioning substantially identical to that of the locking device 30. Like the latter (see FIGS. 7 and 8), it has a casing 41 fixed on the rear bridge 23, a lock 42 in the shape of a circular bell, confined in the casing 41 and having, in its upper wall, a slot 44 for the passage of the cap 17 of the associated locking member 15, a cylindrical cavity 45 capable of receiving the cap 17, as well as a ramp 46 transverse to the slot 44, the bottom of the housing 45 being at a distance d' from the upper surface of the casing 41, which is greater than the distance d.

The differences consist in that the slot 44 is arranged asymmetrically with respect to the longitudinal axis 2, and opens laterally on the side of the lock 42, in that the casing 41 is also provided with an associated slot 41*a*, similar to the slot 44 and opening laterally on the side of the casing, and in that the lock 42 is rotationally mounted in its casing and is provided with a lever 47 for its actuation. Two abutments 48, 49 are also provided in the casing 41 to cooperate with the lever 47 and limit its pivoting between an unlocking position, shown in FIG. 7, where the two slots 41*a* and 44 are aligned and are perpendicular to the cap 17 of the locking member, and a locking position, shown in FIG. 8, where the two slots 41*a* and 44 are perpendicular one to the other.

This locking device 40 comes into play once the locking of the first locking system 15, 30 has occurred. The boot has then pivoted from the position I shown in FIG. 3 to the position II, and it is aligned with the longitudinal axis 2, the rear locking member 15 being engaged in the slots 44 and 41*a* of the lock and casing. At the end of this pivoting movement, the rod 16 of the rear locking member is pressed against the front edge 41*b* of the slot 41*a*, thus achieving a first locking in the longitudinal direction. It then suffices to pivot the lever 47 of the lock 42 until it abuts against the abutment 49 in a locking position to definitely lock the locking member 15 in the associated housing.

During this pivoting, the bottom 44*a* and the sides 44*b* of the slot 44 of that of the lock are pressed against the rod 16 of the locking member 15 and perform a locking in the transverse direction of the rod 16.

As mentioned previously, this locking also occurs with compression of the elastic washer 14 in the vertical direction whereby eliminating any clearance between the locking member 15 and the lock 42.

Therefore, a blocking is obtained both in the longitudinal direction, through the cooperation of the edge 41*b* of the slot 41*a* with the rod 16, in the transverse direction though the cooperation of the sides 44*b* of the slot 44 with the rod 16, and in the vertical direction through the convression of the elastic washer 14.

Since the front locking system 15, 30 is also locked in the transverse and vertical direction, an assembly is obtained free of clearance, in all the vertical, transverse and longitudinal directions, from the boot to the frame, which allows guaranteeing a perfect linkage, similar to a non-removable linkage, and an accurate transmission of all the forces from the boot to the frame, and from the frame to the boot.

It is noted that the compensation of the clearance in the longitudinal direction is particularly interesting in compensating the differences of positions in the longitudinal direction between the locking members 15 which can result from the manufacturing and molding tolerances, for example. Furthermore, this assembly method does not require a rigid sole, is completely compatible with a relatively flexible sole and is appropriate for walking.

The invention is not limited to the particular described embodiment. Thus, the front 15, 30 and rear 15, 40 locking systems could be reversed, for example. As explained previously, the slot of the locking system with a fixed lock could also be provided along a different angle α so as to allow an easier introduction of the boot in the first locking system.

It is also noted that this double locking system is particularly simple to use, does not require any tools and can be done with only one hand, once the boot is on the foot, since what is needed then is to engage the slot of the front locking device of the frame on the associated locking member 15 along an angle α of 45° to 90° (or other), depending on the case, to pivot the frame by engaging the slot of the movable lock on the second locking member, and then to pivot the movable lock to obtain the final locking and assembly.

FIGS. 9–13 show another embodiment in which the identical or similar elements are designated by the same references, increased by 100. The essential difference with respect to the preceding embodiment is that the slots 144, 141*a* of the rear lock 142 and of the corresponding casing 141 do not open and are centered on the longitudinal axis 2 so that the rear locking member 115 is engaged in the slots in the vertical direction, after a slight flexion of the cradle 111/sole and after the front locking member 115 is locked.

Figure 10:
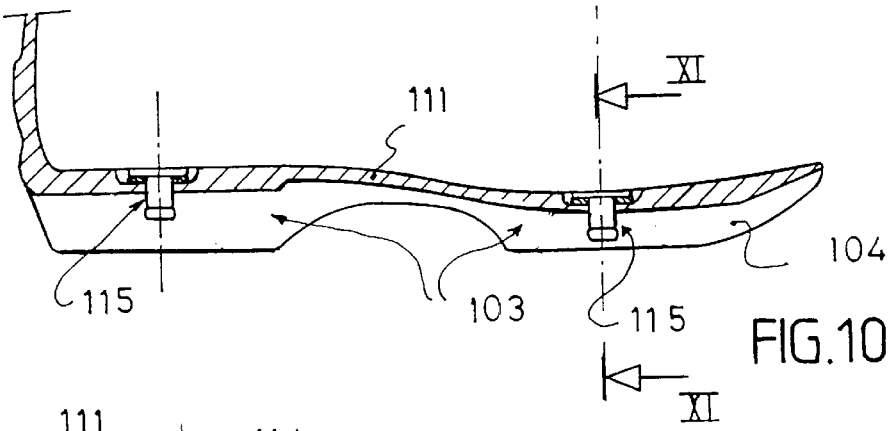
FIG. 10 is a partial longitudinal cross-sectional view of a boot according to a second embodiment.
Figure 11:
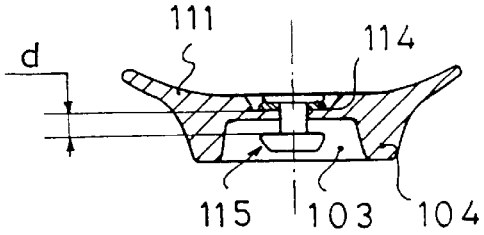
FIG. 11 is a cross-sectional view along the line XI—XI of FIG. 10.
Figure 12:
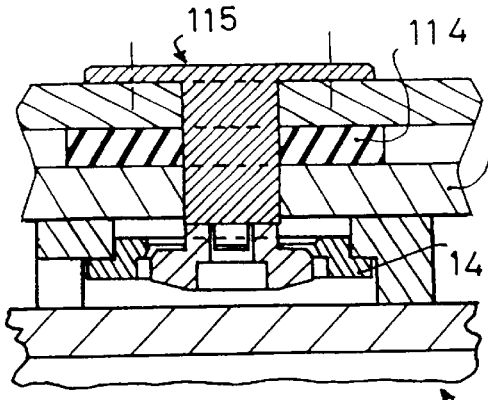
FIG. 12 is a view similar to FIG. 5 of the rear locking system in an unlocked position, according to a second embodiment.
Figure 13:
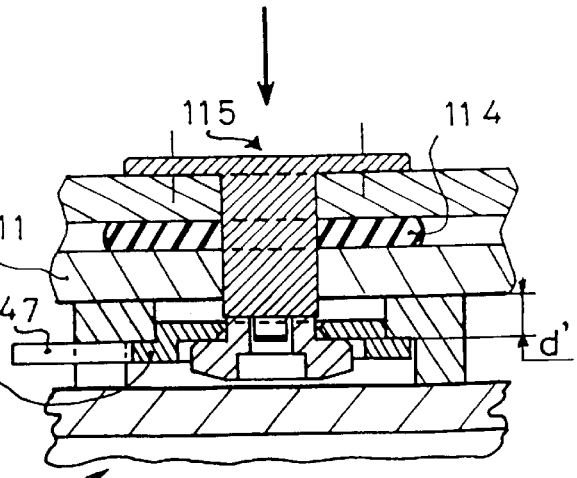
FIG. 13 is a view similar to FIG. 12 in a locking position.

Moreover, as shown in FIGS. 10 and 11, each locking member 115 is mounted on the bottom of a longitudinal groove or recess 103 demarcated, on the one hand, by the exterior surface of the cradle 111 and, on the other hand, by a peripheral edge 104 constituted, for example, of rubber and forming a wear sole. Such a construction requires a cradle 111 and a sole 104 sufficiently flexible to be capable of being bent and introduced in the vertical direction. This construction has the advantage that the locking members 115 are protected by the peripheral edge 104.

Depending on the sport article on which the boot is fixed, the longitudinal groove can be advantageous for cooperating with a guiding system of the associated longitudinal rib type. Such a groove can also be advantageously replaced by mere, substantially cylindrical cutouts, provided in the walking sole 104 around each locking member 115, this embodiment yet allowing a better protection of the locking members.

Furthermore, the peripheral edge 104 has a more appropriate surface for walking. Therefore, a boot is obtained that is compatible for walking and also capable of being appropriately fixed to the frame.

The present invention is not limited to the previously described embodiments given by way of non-limiting examples, but covers all similar or equivalent embodiments with the object of overcoming the same problems.

Thus, other means for obtaining blockings in the transverse and longitudinal directions could be envisioned without leaving the scope of the present invention.

The instant application is based upon the French priority patent application No. 97 16746 filed Dec. 23, 1997, the disclosure of which is hereby expressly incorporated by reference thereto in its entirety, and the priority of which is hereby claimed under 35 USC 119.

What is claimed is:

1. An assembly comprising:

a boot comprising at least one locking member and sport article comprising at least one associated locking devise complementary to said locking member of said boot, said locking member of said boot and said locking device of said sport article define a locking system, said locking system having a locking operation to lock said boot to said sport article and an unlocking operation to unlock said boot from said sport article;

said locking system comprising at least one elastically displaceable element mounted for movement in a direction having a vertical component during said locking operation to block said boot with regard to said sport article by a traction force in said direction;

each of said at least one locking member comprising a projecting part comprising a substantially T-shaped cap; and each of said at least one locking device comprising a lock configured to cooperate with a respective one of said at least one locking member.

2. An assembly according to claim 1, wherein:

said elastically displaceable element of said locking system is constituted by said at least one locking member of said boot.

3. An assembly according to claim 1, wherein:

at least one said lock is rotatable.

4. An assembly according to claim 3, wherein:

said rotatable lock is provided with one passage slot for said cap of a respective one of said at least one locking member, said passage slot being mounted for rotation and displacement by means of a lever from an unlocking position, said slot being substantially parallel to a direction in which said cap extends in said unlocking position, to a locking position, said slot being substantially perpendicular to said direction in which said cap extends in said locking postion.

5. An assembly according to claim 4, wherein:

each of said at least one locking member further comprises a rod extending from said cap;

said rotatable lock further comprises a fixed casing having an edge configured for being pressed against said rod of said at least one locking member for locking in a longitudinal direction of said rod.

6. An assembly according to claim 4, wherein:

said rotatable lock comprises a circular bell provided with said one passage slot for said cap of a respective one of said at least one locking member.

7. An assembly according to claim 1, wherein:

at least one said lock is fixed.

8. An assembly according to claim 7, wherein:

said fixed lock comprises a housing configured to receive said cap of a respective one of said at least one locking member during a rotation of said one locking member along a predetermined angle, said housing being closed at an upper end and provided with an engagement slot for said cap oriented along an angle with respect to an orientation of said cap.

9. An assembly according to claim 1, wherein:

said locking system comprises a first locking system;

said at least one locking member comprises a second locking member and said at least one associated locking device comprises a second associated locking device, said second locking member and said second associated locking device defining a second locking system;

said first locking system is adapted to be positioned in an area of metatarsal bones of a user's foot and said second locking system is adapted to be positioned in an area of a heel of a user's foot.

10. An assembly according to claim 1, wherein:

each of said at least one locking member is elastically displaceably mounted with respect to said boot in said direction.

11. An assembly according to claim 10, wherein:

said boot further comprises a bottom, said bottom having a through hole;

each of said at least one locking member further comprises a rod extending from said cap, said rod being slidably mounted within said through hole; and an elastic element is positioned around said rod.

12. An assembly according to claim 11, wherein:

said bottom of said boot further comprises a cradle and a wear sole, at least one recess being demarcated by an external surface of said cradle and by said wear sole;

each of said at least one locking member projects into said at least one recess.

13. An assembly according to claim 1, wherein:

each of said at least one locking member and an associated one of said at least one lock being configured for relative rotation during said operation; and each of said at least one lock comprises at least one ramp configured for exerting a vertically directed traction force on a respective one of said locking members during said relative rotation.

14. An assembly according to claim 1, wherein:

each of said at least one locking defines abutments in a transverse direction.

15. An assembly according to claim 1, wherein:

said locking system comprises a first locking system;

said at least one locking member comprises a second locking member and said at least one associated locking device comprises a second associated locking device, said second locking member and said second associated locking device defining a second locking system;

said first locking system is adapted to be positioned in an area of metatarsal bones of a user's foot and said second locking system is adapted to be positioned in an area of a heel of a user's foot;

said lock of one of said first and second locking systems comprises a rotatable lock and said lock of a second of said first and second locking systems comprises a fixed lock.

16. An assembly according to claim 1, wherein:

said sport article comprises a chassis of an in-line roller skate.

17. An assembly according to claim 1, wherein:

said at least one locking member comprises two locking members and said at least one associated locking device comprises two associated locking devices;

said boot and said sport article are connected together only by means of said two locking members and said two associated locking devices.

18. An assembly according to claim 1, wherein:

said sport article comprises a chassis of a skate.

* * * * *